US008793946B2

(12) United States Patent
Stahl, Jr. et al.

(10) Patent No.: US 8,793,946 B2
(45) Date of Patent: Aug. 5, 2014

(54) MEANS FOR FIRESTOPPING A CURTAIN WALL CONSTRUCTION

(75) Inventors: James P. Stahl, Jr., Princeton Junction, NJ (US); Julio Lopes, Dunellen, NJ (US); Christopher DeMarco, Stewartsville, NJ (US)

(73) Assignee: Specified Technologies Inc., Somerville, NJ (US)

( * ) Notice: Subject to any disclaimer, the term of this patent is extended or adjusted under 35 U.S.C. 154(b) by 0 days.

(21) Appl. No.: 13/573,051

(22) Filed: Aug. 16, 2012

(65) Prior Publication Data

US 2013/0061544 A1 Mar. 14, 2013

Related U.S. Application Data

(60) Provisional application No. 61/573,862, filed on Sep. 13, 2011.

(51) Int. Cl.

| | |
|---|---|
| ***E04H 1/00*** | (2006.01) |
| ***E04C 2/00*** | (2006.01) |
| ***E04B 2/96*** | (2006.01) |
| ***A62C 2/10*** | (2006.01) |

(52) U.S. Cl.

CPC ... *A62C 2/10* (2013.01); *E04B 2/96* (2013.01); *Y10S 52/12* (2013.01)

USPC ..... 52/232; 52/1; 52/DIG. 12

(58) Field of Classification Search

USPC ..... 52/1, 232, DIG. 12

See application file for complete search history.

(56) References Cited

U.S. PATENT DOCUMENTS

| | | | |
|---|---|---|---|
| 466,831 | A | 1/1892 | Palmer |
| 623,385 | A | 4/1899 | Sprinkel |
| 792,603 | A | 6/1905 | Lyman et al. |
| 876,171 | A | 1/1908 | Graszynski |
| 886,968 | A | 5/1908 | Fuller |
| 2,365,127 | A | 12/1944 | Wagner |
| 2,736,399 | A | 2/1956 | Spencer |
| 3,766,958 | A | 10/1973 | Mitchell |

(Continued)

FOREIGN PATENT DOCUMENTS

| | | | | |
|---|---|---|---|---|
| AU | 2010224332 | A1 | * | 4/2011 |
| JP | 2003253795 | A | * | 9/2003 |
| JP | 2011196093 | A | * | 10/2011 |
| SU | 1625498 | A | * | 2/1991 |

OTHER PUBLICATIONS

Hinata et al., Machine translation of JP02003253795A, Date pulled Oct. 1, 2013, p. 1-4.*

*Primary Examiner* — Elizabeth A Plummer

(74) *Attorney, Agent, or Firm* — Sperry, Zoda & Kane

(57) ABSTRACT

A blanket or curtain of flexible fire retardant material is collapsed and retained within a retaining housing construction positioned adjacent to a curtain wall assembly for firestop sealing thereover. The housing includes a safing angle member secured to the curtain wall assembly and a cover which releases responsive to sensing fire conditions to allow the firestopping blanket to deploy downwardly to extend between curtain wall framing members and be positioned extending across a curtain wall panel for fire protection thereover. Such curtain wall panels are commonly made of glass which tends to fracture during a hot fire. The cover will release the blanket responsive to controlled failure of fusible links which secure the cover to the safing angle member. After deployment the blanket will deflect fire and heat away from the curtain wall panel to prevent the spread of fire to adjacent floors.

24 Claims, 15 Drawing Sheets

(56) References Cited

U.S. PATENT DOCUMENTS

| | | | | | |
|---|---|---|---|---|---|
| 3,968,841 | A | | 7/1976 | Harmathy | |
| 4,077,474 | A | * | 3/1978 | Hattori | 169/48 |
| 4,161,204 | A | | 7/1979 | Kurz | |
| 4,269,901 | A | | 5/1981 | Chamberlain | |
| 4,297,821 | A | | 11/1981 | Peters | |
| 4,449,341 | A | * | 5/1984 | Taglianetti et al. | 52/235 |
| 4,631,884 | A | * | 12/1986 | Reynolds | 52/235 |
| 4,791,994 | A | | 12/1988 | Ho | |
| 5,423,150 | A | * | 6/1995 | Hitchcock | 52/1 |
| 5,607,758 | A | | 3/1997 | Schwartz | |
| 5,608,992 | A | | 3/1997 | Floyd | |
| 5,782,690 | A | | 7/1998 | Gustafson et al. | |
| 5,809,699 | A | | 9/1998 | Joly | |
| 5,860,251 | A | | 1/1999 | Gleich | |
| 6,182,407 | B1 | | 2/2001 | Turpin et al. | |
| 6,357,507 | B1 | * | 3/2002 | Stoebich et al. | 160/41 |
| 6,367,212 | B1 | | 4/2002 | Manning | |
| 6,401,487 | B1 | | 6/2002 | Kotliar | |
| 6,418,752 | B2 | | 7/2002 | Kotliar | |
| 6,857,233 | B2 | * | 2/2005 | Farag | 52/235 |
| 6,918,447 | B2 | | 7/2005 | Robinson, Jr. | |
| 7,000,668 | B2 | * | 2/2006 | Sears et al. | 160/7 |
| 7,028,742 | B2 | * | 4/2006 | Sears et al. | 160/310 |
| 7,096,629 | B1 | | 8/2006 | Cox | |
| 7,299,848 | B2 | * | 11/2007 | Streib et al. | 160/9 |
| 7,482,919 | B1 | | 1/2009 | Franklin | |
| 7,886,491 | B1 | * | 2/2011 | Shriver | 52/235 |
| 2002/0059985 | A1 | | 5/2002 | Stoebich et al. | |
| 2004/0159448 | A1 | | 8/2004 | Robinson, Jr. | |
| 2006/0266263 | A1 | | 11/2006 | Giesemann | |
| 2007/0204540 | A1 | | 9/2007 | Stahl et al. | |
| 2007/0275231 | A1 | | 11/2007 | Meyer et al. | |
| 2008/0295425 | A1 | * | 12/2008 | Farag | 52/235 |
| 2009/0008039 | A1 | | 1/2009 | Lambridis | |

* cited by examiner

MEANS FOR FIRESTOPPING A CURTAIN WALL CONSTRUCTION

The present utility application hereby formally claims priority of U.S. Provisional Patent application No. 61/573,862 filed Sep. 13, 2011 "A Construction for Firestop Sealing a Building Perimeter Gap Utilizing a Deployable Fire Protective Curtain and Edge of Floor Safing Gap Gasket" filed by the same inventor listed herein, namely, James P Stahl Jr and Julio Lopes and Christopher De Marco, and assigned to the same assignee, namely, Specified Technologies Inc., said referenced provisional application being hereby formally incorporated by reference as an integral part of the present application.

BACKGROUND OF THE INVENTION

The present invention deals with the field of fireproofing buildings and, particularly, fireproofing between a floor such as a concrete slab and a curtain wall positioned immediately outwardly therefrom. A space is commonly defined between the outer edge of a floor and the curtain wall normally formed by vertical and horizontal framing members with curtain wall panels extending therebetween which are normally transparent and formed of glass. The present invention provides a means for sealing this space or safing gap defined between the outer edge of the floor and the curtain wall for firestopping thereof and preventing the spread of fire vertically between floors.

DESCRIPTION OF THE PRIOR ART

Many patents have been granted for peripheral building firestopping such as shown in U.S. Pat. No. 466,831 patented Jan. 12, 1892 to P. A. Palmer on a "Means For Protecting Buildings From Fire"; and U.S. Pat. No. 623,385 patented Apr. 18, 1899 to J. A. Sprinkel on a "Fireproof Awning And Curtain"; and U.S. Pat. No. 792,603 patented Jun. 20, 1905 to T. T. Lyman and H. C. Hood, said Lyman assignor to H. W. Johns-Manville Company on a "Fireproof Shutter"; and U.S. Pat. No. 876,171 patented Jan. 7, 1908 to P. W. Graszynski on a "Fireproof Building"; and U.S. Pat. No. 886,968 patented May 5, 1908 to A. M. Fuller on a "Fire Curtain"; and U.S. Pat. No. 2,365,127 patented Dec. 12, 1944 to P. R. Wagner on a "Conflagration Retardative Curtain"; and U.S. Pat. No. 2,736,399 patented Feb. 28, 1956 to H. R. Spencer and assigned to The Erie Enameling Company on a "Wall Structure"; and U.S. Pat. No. 3,766,958 patented Oct. 23, 1973 to N. D. Mitchell on a "Fire Protection Device For Building Structure"; and U.S. Pat. No. 3,968,841 patented Jul. 13, 1976 to T. Z. Harmathy and assigned to Canadian Patents and Development Limited on a "Flame Deflecting Device For Mounting On A Building Exterior"; and U.S. Pat. No. 4,161,204 patented Jul. 17, 1979 to J. C. Kurz on a "Motorized Smoke And Fire Damper"; and U.S. Pat. No. 4,269,901 patented May 26, 1981 to F. N. Chamberlain on a "Device For Protection Against Fire"; and U.S. Pat. No. 4,297,821 patented Nov. 3, 1981 to L. R. Peters on "Building Structures Having Improved Fire Resistant Properties"; and U.S. Pat. No. 4,791,994 patented Dec. 20, 1988 to I Ho on a "Book/Painting/Treasure Equipment Saver"; and U.S. Pat. No. 5,607,758 patented Mar. 4, 1997 to W. C. Schwartz and assigned to BGF Industries, Inc. on a "Smoke Containment Curtain"; and U.S. Pat. No. 5,608,992 patented Mar. 11, 1997 to A. Floyd on a "Fire Resistant House Cover"; and U.S. Pat. No. 5,782,690 patented Jul. 21, 1998 to B. K. Gustafson et al and assigned to International Business Machines Corporation on a "Curtain Fire Damper"; and U.S. Pat. No. 5,809,699 patented Sep. 22, 1998 to M. Joly and assigned to Societe D'Exploitation Du Parc Des Expositions De La Ville De Paris on a "Fire Curtain"; and U.S. Pat. No. 5,860,251 patented Jan. 19, 1999 to J. Gleich on a "Rapidly Deployable Fire-Protection Apparatus"; and U.S. Pat. No. 6,182,407 patented Feb. 6, 2001 to K. A. Turpin et al and assigned to John Manville International, inc. on a "Gypsum Board/Intumescent Material Fire Barrier Wall"; and U.S. Pat. No. 6,367,212 patented Apr. 9, 2002 to N. C. Manning on a "Fire-Retardant Roof Construction"; and U.S. Pat. No. 6,401,487 patented Jun. 11, 2002 to I. K. Kotliar on "Hypoxic Fire Prevention And Fire Suppression Systems With Breathable Fire Extinguishing Compositions For Human Occupied Environments"; and U.S. Pat. No. 6,418,752 patented Jul. 16, 2002 to I. K. Kotliar on "Hypoxic Fire Prevention And Fire Suppression Systems And Breathable Fire Extinguishing Compositions For Human Occupied Environments"; and U.S. Pat. No. 6,918,447 patented Jul. 19, 2005 to E. L. Robinson, Jr. on a "Fire Protection Apparatus And Method"; and U.S. Pat. No. 7,096,629 patented Aug. 29, 2006 to F. Cox on an "Exterior Wall Cladding System For Panels Of Thin Reinforced Natural Stone"; and U.S. Pat. No. 7,482,919 patented Jan. 27, 2009 to L. Franklin on a "Multi-Functional Emergency Egress System"; and United States Publication No. 2002/0059985 published May 23, 2002 to J. Stoebich et al on a "Curtain Arrangement For Preventing Spread Of Smoke"; and United States Publication No. 2004/0159448 published Aug. 19, 2004 to E. L. Robinson, Jr. on a "Fire Protection Apparatus And Method"; and United States Publication No. 2006/0266263 published Nov. 30, 2006 to H. Giesemann on an "Extremely Fireproof Inorganic Foamed Plastic Body"; and United States Publication No. 2007/0204540 published Sep. 6, 2007 to J. P. Stahl, Sr. and J. P. Stahl, Jr. and assigned to Specified Technologies Inc. on a "Means And Method For Fireproof Sealing Between The Peripheral Edge Of Individual Floors Of A Building And The Exterior Wall Structure Thereof"; and United States Publication No. 2007/0275231 published Nov. 29, 2007 to G. Meyer et al and assigned to Scheuten Glasgroep on a "Fire Protection Means And Method For The Production Thereof"; and United States Publication No. 2009/0008039 published Jan. 8, 2009 to A. C. Lambridis and assigned to McKeon Rolling Steel Door Co., Inc. on a "Fire And/Or Smoke Blocking Device".

SUMMARY OF THE INVENTION

The present invention provides a firestopping means for use with a conventional curtain wall construction which includes a curtain wall assembly having a plurality of vertical frame members spatially disposed from one another and extending generally vertically. Also the assembly includes a plurality of horizontal framing members spatially disposed from one another and extending generally horizontally between the vertical framing members. A plurality of curtain wall panels are included extending between the vertical frame members and between the horizontal frame members. The firestopping means is designed to be attached to the curtain wall assembly and extend between vertical framing portions along the horizontal framing members at locations above the curtain wall panels extending therebetween. This firestopping means includes a retaining housing positioned adjacent to the curtain wall assembly which includes a safing angle member positioned adjacent to the curtain wall assembly and a cover member detachably secured to the safing angle member and defining therebetween a retaining chamber. A releasable attachment means is also included detachably securing the cover member with respect to the safing angle member. This releasable attachment means is responsive to exposure to fire conditions to disengage the cover member from the safing angle member. A curtain blanket is included having a secured portion thereof attached to the safing angle member and including a free portion thereof. The blanket member can be wrapped such as being rolled or pleated and held in a stored position. The curtain blanket is preferably of a flexible fire resistant material. When oriented in the stored position the curtain blanket can be positioned within the retaining means of the retaining housing. The releasable attachment means will be responsive to exposure to fire conditions to disengage the cover member from attachment with respect to the safing angle member to allow the free portion of the curtain blanket to unfurl and move downwardly to a deployed position extending at least partially across the curtain wall panel located thereadjacent for firestopping thereover.

It is an object of the construction of the present invention to prevent fire from spreading between vertically adjacent floors of a building by sealing between the floor and outer wall thereof.

It is an object of the construction of the present invention to seal between the outer edge of a concrete slab and a curtain wall assembly positioned immediately thereadjacent and separated therefrom by a safing gap wherein the curtain wall assembly is formed by a plurality of vertical and horizontal framing members with curtain wall panels extending therebetween usually being transparent and usually formed of glass.

It is an object of the construction of the present invention to be easy to install and easy to maintain.

It is an object of the construction of the present invention to be of minimal initial cost outlay and have minimal maintenance requirements.

It is an object of the construction of the present invention to include a flexible sealing gasket formed of a fire retardant cushion such as mineral fiber encapsulated in polyurethane facing which can adapt to various different sizes in the safing gaps of various buildings and various locations within a single building.

It is an object of the construction of the present invention to provide a stored fire retardant flexible blanket which can be either rolled or folded within a chamber formed by a safing member and a cover member which automatically deploys responsive to fire conditions.

It is an object of the construction of the present invention to provide a construction which utilizes a fusible link preferably of lead, plastic or other similar materials with a low melt point to connect the safing angle member with respect to the cover member which are pre-designed to fail to facilitate downward deployment of the rolled or folded curtain due to gravitational forces exerted upon an activation weight secured thereto.

It is an object of the construction of the present invention to provide a deployable curtain blanket member which is usable for fire protection of floor to ceiling glass in buildings.

It is an object of the construction of the present invention to be usable with a separate membrane which can be factory applied as a means for forming a secondary seal for water or water vapor as may be deemed necessary.

BRIEF DESCRIPTION OF THE DRAWINGS

While the invention is particularly pointed out and distinctly described herein, a preferred embodiment is set forth in the following detailed description which may be best understood when read in connection with the accompanying drawings, in which.

DETAILED DESCRIPTION OF THE PREFERRED EMBODIMENT

Figure 1:
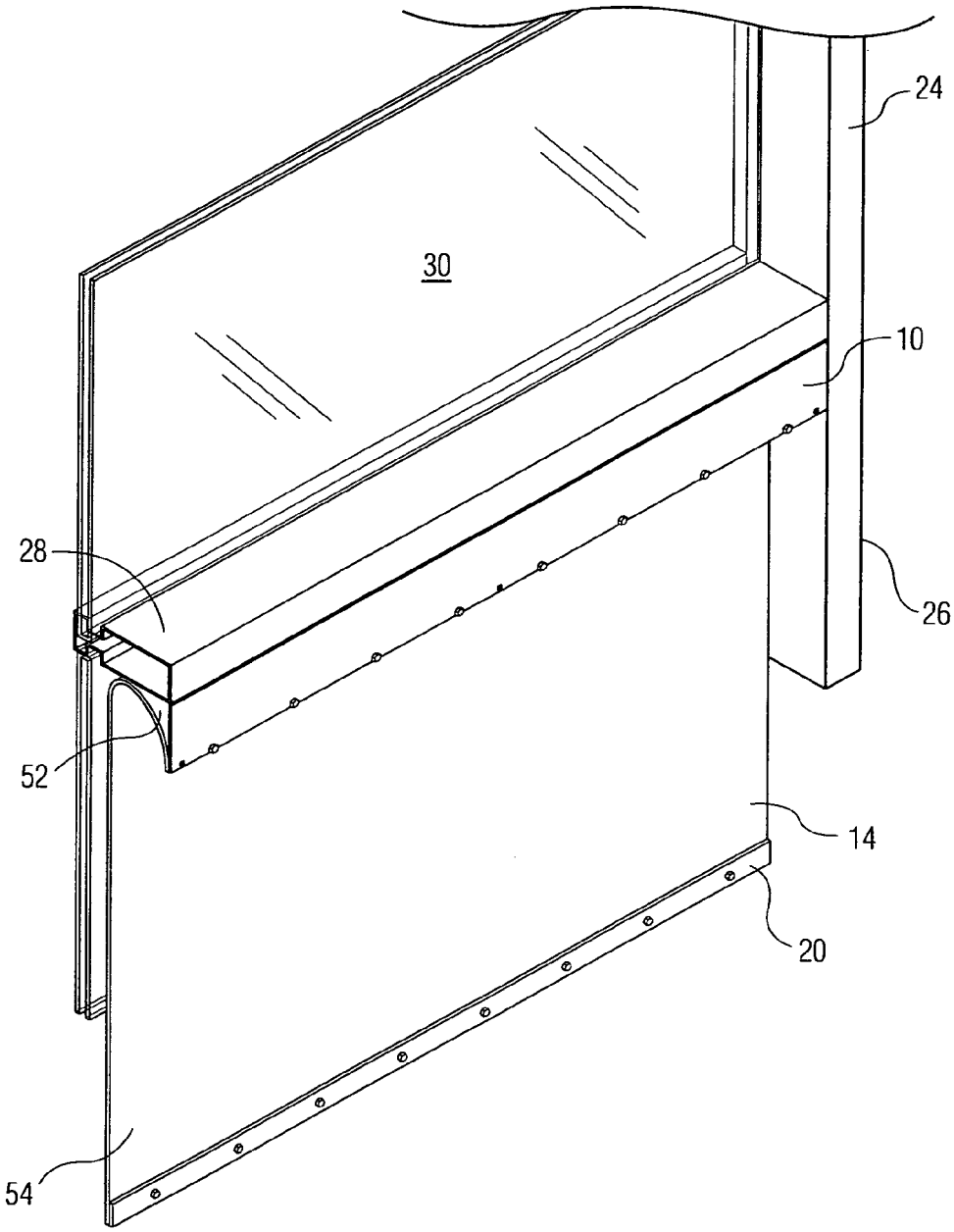
FIG. 1 is a perspective view showing the curtain wall assembly of the present invention with the curtain blanket member fully deployed extending over at least a portion of the curtain wall as viewed from the building interior.
Figure 2:
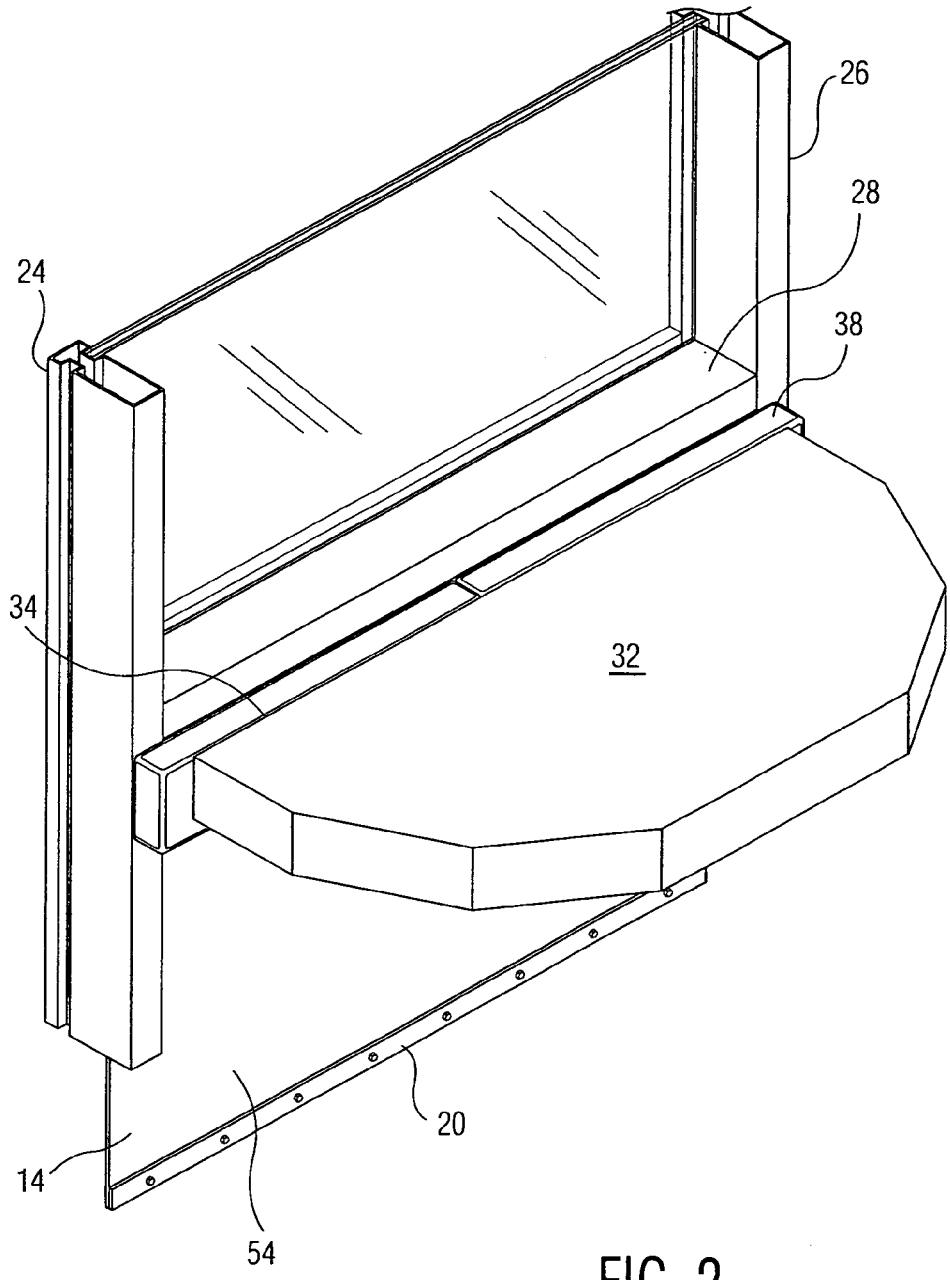
FIG. 2 is a perspective view of the embodiment shown in FIG. 1 including the positioning of the concrete slab building floor with a safing gap insulation member in place.

The present invention provides a construction for firestop sealing across the span on the inside of curtain wall panels 30 which are position outside of the outer edge 34 of interior building floors 32 which are normally of concrete and separate from the curtain wall assembly 24 by a gap or space commonly referenced as the safing gap 36. In the conventional construction of buildings having curtain walls 24 the outer edges 34 of the individual floors 32 thereof need to include some type of a firestopping means for firestop sealing of the safing gap 36 positioned therebetween. Furthermore, such construction designs need fireproofing to prevent fire from spreading from floor to adjacent upper floor through fractured curtain walls panel 24 which can easily break responsive to fire since they are often of transparent materials such as glass. This spread of fire and heat and smoke to upper floor from lower floors can travel through the safing gap 36 and as such a safing gap insulation member 38 is preferably placed therewithin.

Such curtain wall constructions 24 commonly include vertical framing members 26 and horizontal framing members 28 with curtain wall panels 30 extending therebetween. It is important to protect against fire spreading to upper floors through broken curtain wall panels and upwardly along the outside surface of a building. Such curtain wall panels 30 are usually transparent and often of glass and can easily fracture responsive to the heat and flame conditions of a fire. The destruction of the curtain wall panels 30 during a fire can allow the fire to travel upwardly along the outside of the building to the next floor and fracture the curtain wall panel 30 on the next floor and thereby allow the fire to leap from a given floor to an immediately floor thereabove by traveling up the exterior of the building until it traveled many floors upwardly quite quickly. The present invention provides a means for inhibiting this spread of fire upwardly between adjacent vertical floors along the building exterior by inhibiting the fire flames from traveling from the building interior to the building exterior through fractured curtain wall panels 30.

Figure 9:
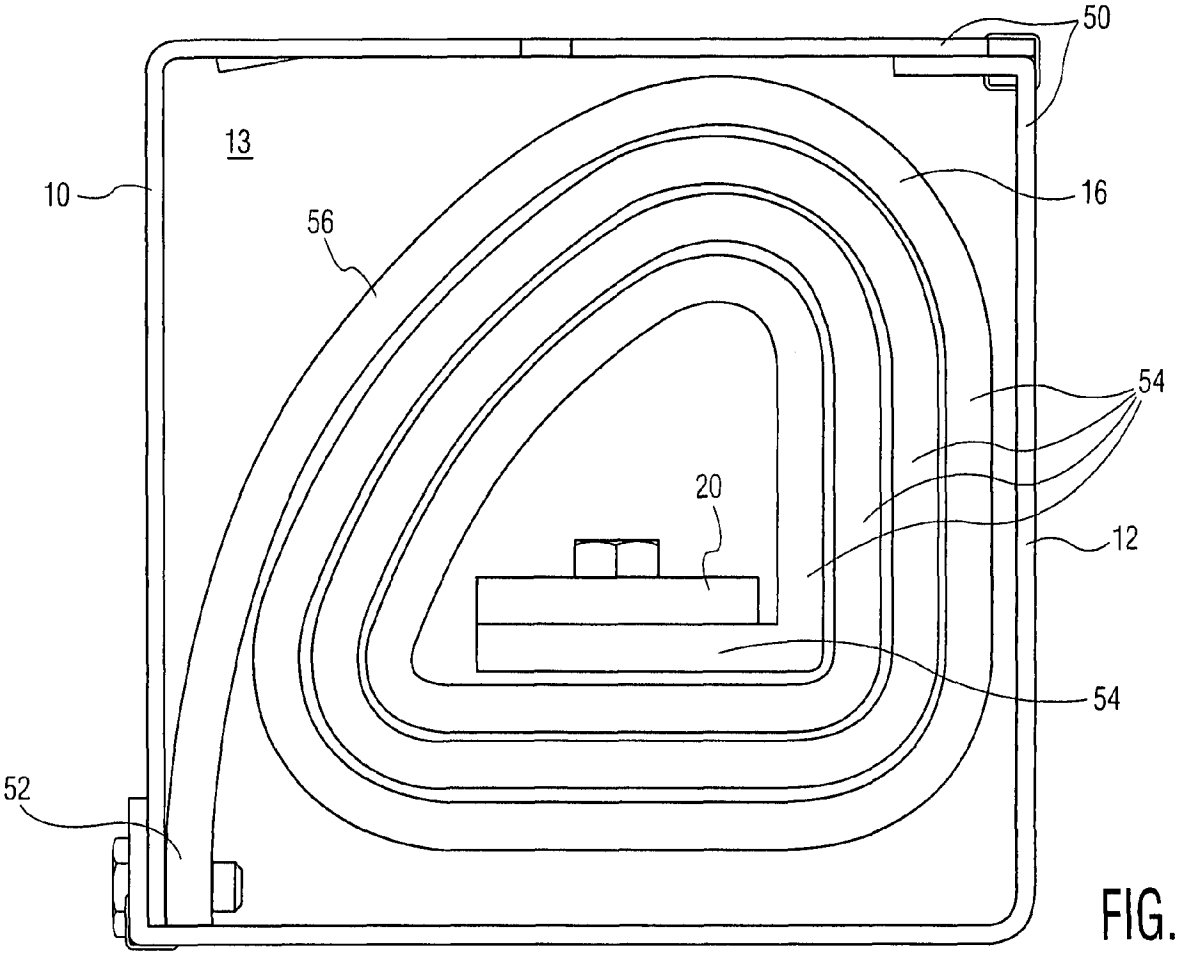
FIG. 9 is a side plan view of the curtain blanket member which is rolled and shown contained within the retaining chamber defined between the safing angle member and the cover member.
Figure 13:
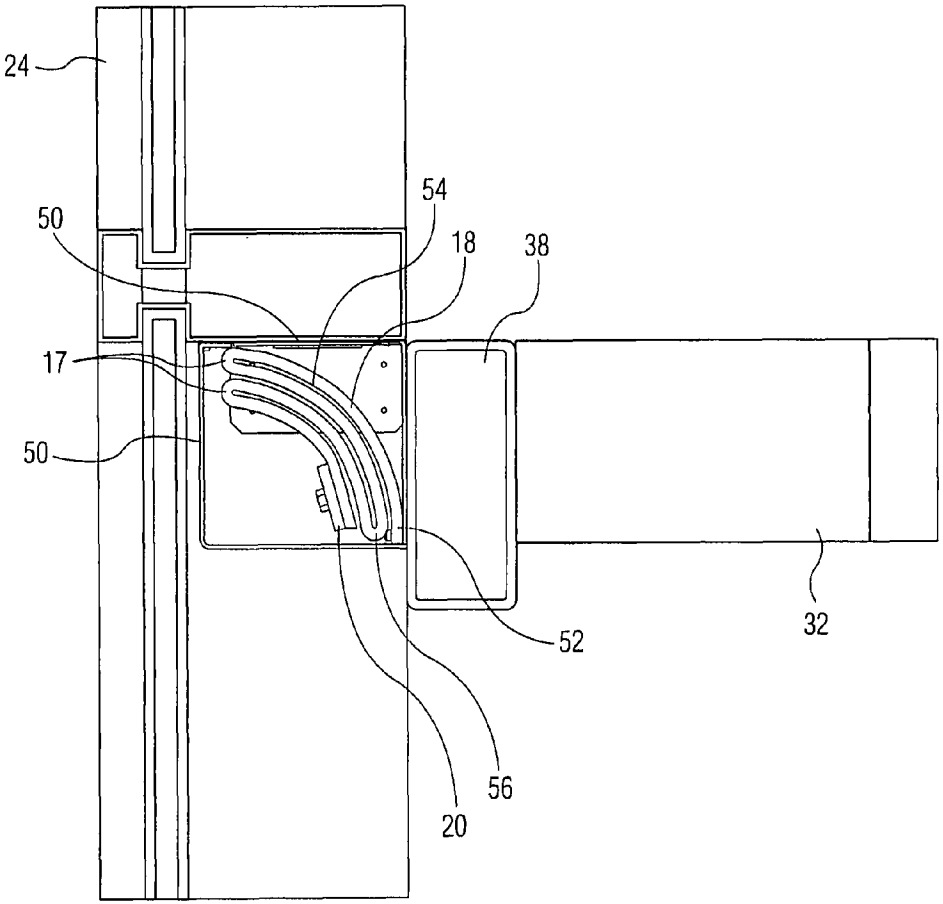
FIG. 13 is a cross-sectional view of an illustration of an alternative embodiment of the apparatus of the present invention similar to FIG. 10 but utilizing the folded configuration for the curtain blanket member.
Figure 14:
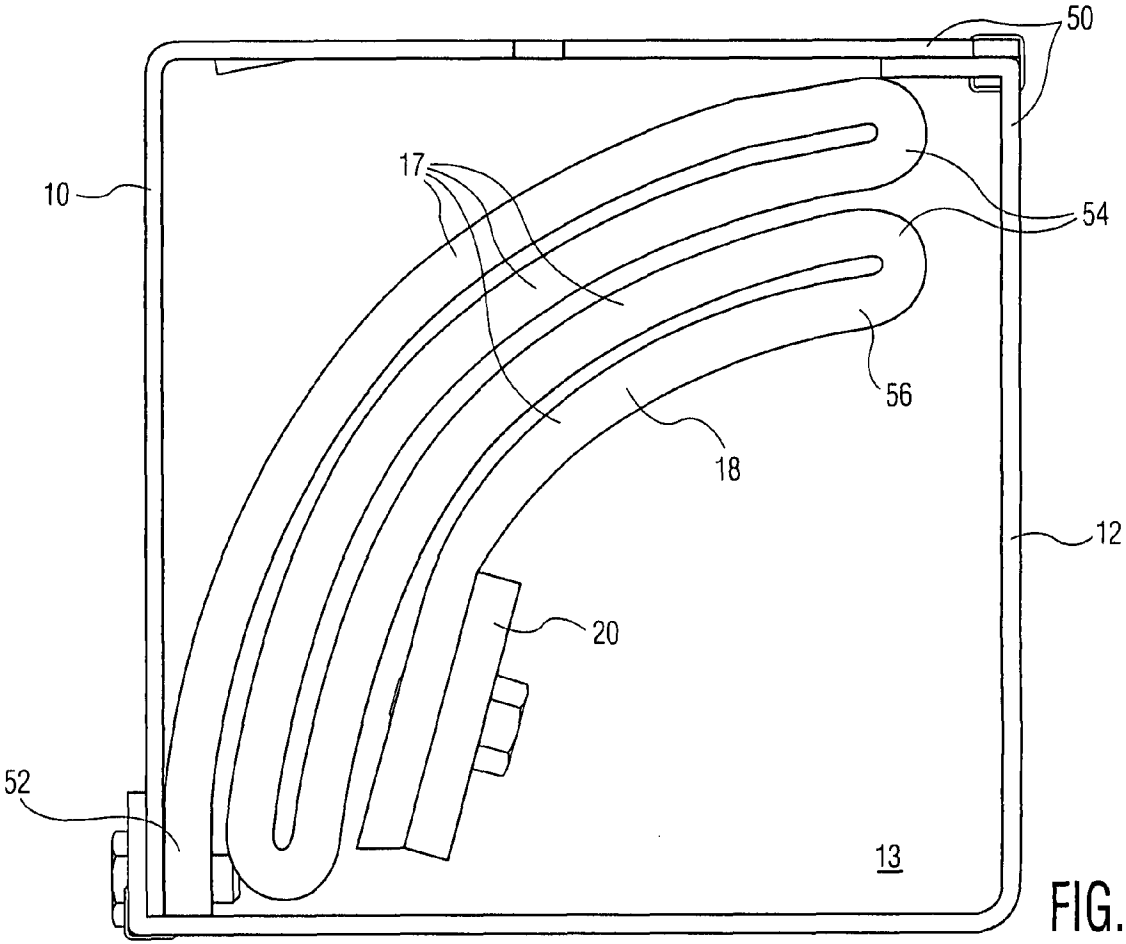
FIG. 14 is a side plan view of the embodiment shown in FIG. 13 showing a folded curtain blanket member.
Figure 15:
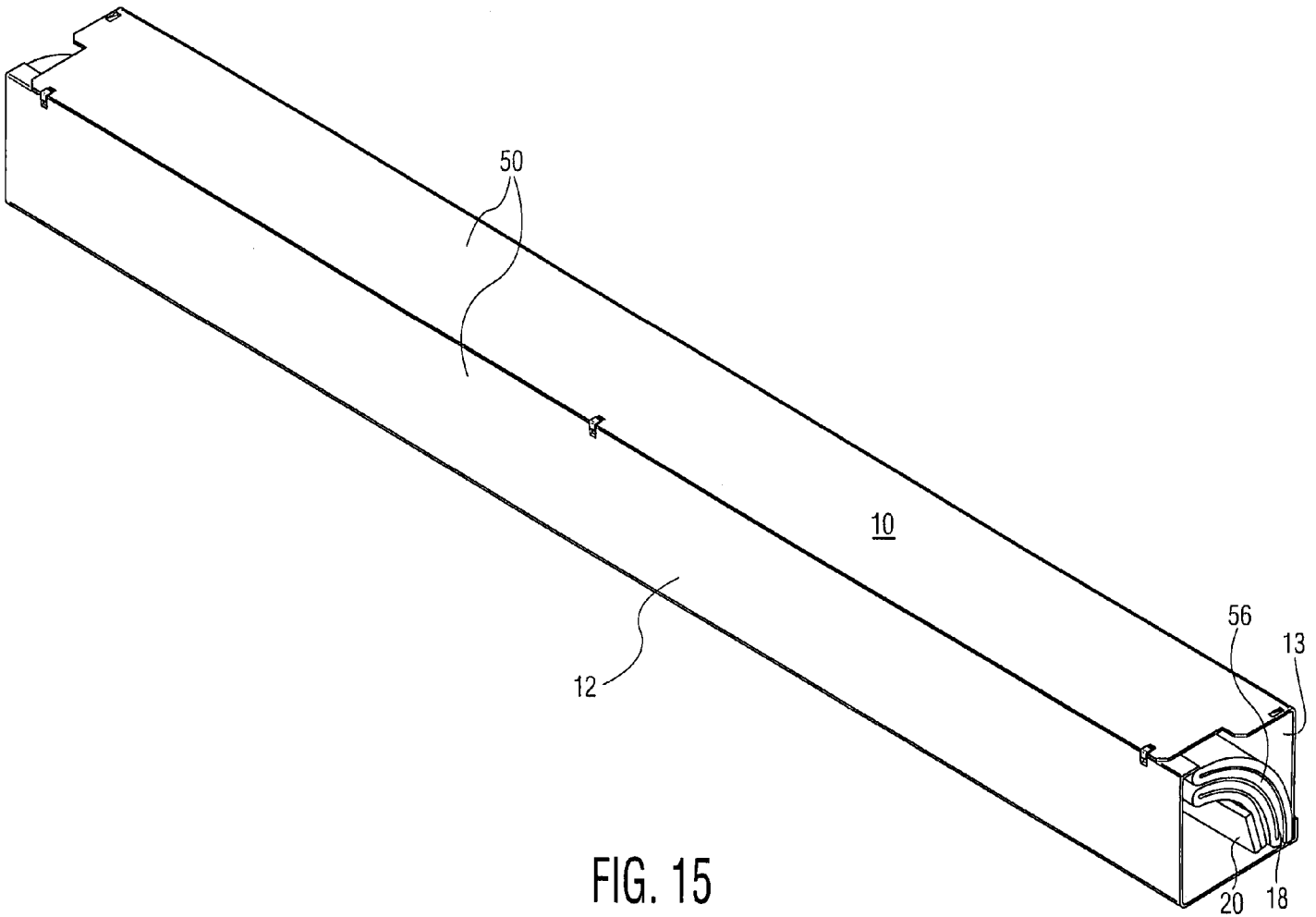
FIG. 15 is an illustration identical to FIG. 7 except for the inclusion of a folded curtain rather than a rolled curtain configuration.

With the construction of the present invention a safing angle member 10 preferably of steel material and a cover member 12 are detachably secured with respect to one another solely by a plurality of releasable attachment means 22 such as fusible links 22. Such fusible links could comprise lead or thermoplastic attachment means with a relatively low melting point to facilitate speedy release of attachment means 22 responsive to being exposed to fire and or heat. Disengagement of the releasable attachment means 22 will release the cover member 12 from engagement with the safing angle member 10. Since the safing angle member 10 is preferably secured with respect to the building the cover member 12 normally falls away therefrom downwardly. The cover member is normally formed of an aluminum or a non-metallic material and the safing angle member 10 is preferably of steel. These two members when secured together by the releasable attachment means 22 define therewithin retaining chamber means 13. This retaining chamber means 13 holds a curtain blanket member 14 therein. The curtain blanket member 14 is preferably of a flexible fire retardant material such as a fire retardant ceramic fiber blanket. It is totally retained within the retaining chamber means 13 defined between the safing angle member 10 and the cover member 12 within the retaining chamber means 13 defined therebetween in the steady state condition prior to exposure thereof to fire or heat. The blanket 14 can be retained in the stored or undeployed stored position 56 in a rolled manner such as shown by rolled curtain 16 in FIG. 9 or it can be folded with pleats 17 as shown by folded curtain 18 in FIG. 13.

When the releasable attachment means or fusible link means 22 disengages and the cover member 12 falls away from the safing angle member 10 the curtain blanket member 14 will be free to fall downwardly and unfurl or unfold. The curtain blanket 14 preferably includes a secured portion 52 which is attached to the safing angle member 10 and a free portion 54 which can freely unfurl or unfold as it moves downwardly due to gravitation force after full disengagement of the cover member 12 from safing angle member 10. An activation weight 20 can be secured with respect to the free portion 54 of the rolled curtain 16 or the folded curtain 18 preferably along the lowermost edge of the free portion 54 such that when it falls downwardly from the stored or secured position 56 toward the fully deployed position 40 gravitational forces acting upon the curtains 16 and 18 and, most particularly, upon the activation weight 20 will cause the curtain to unfold or unroll downwardly to the fully deployed position as shown in FIG. 1.

Figure 3:
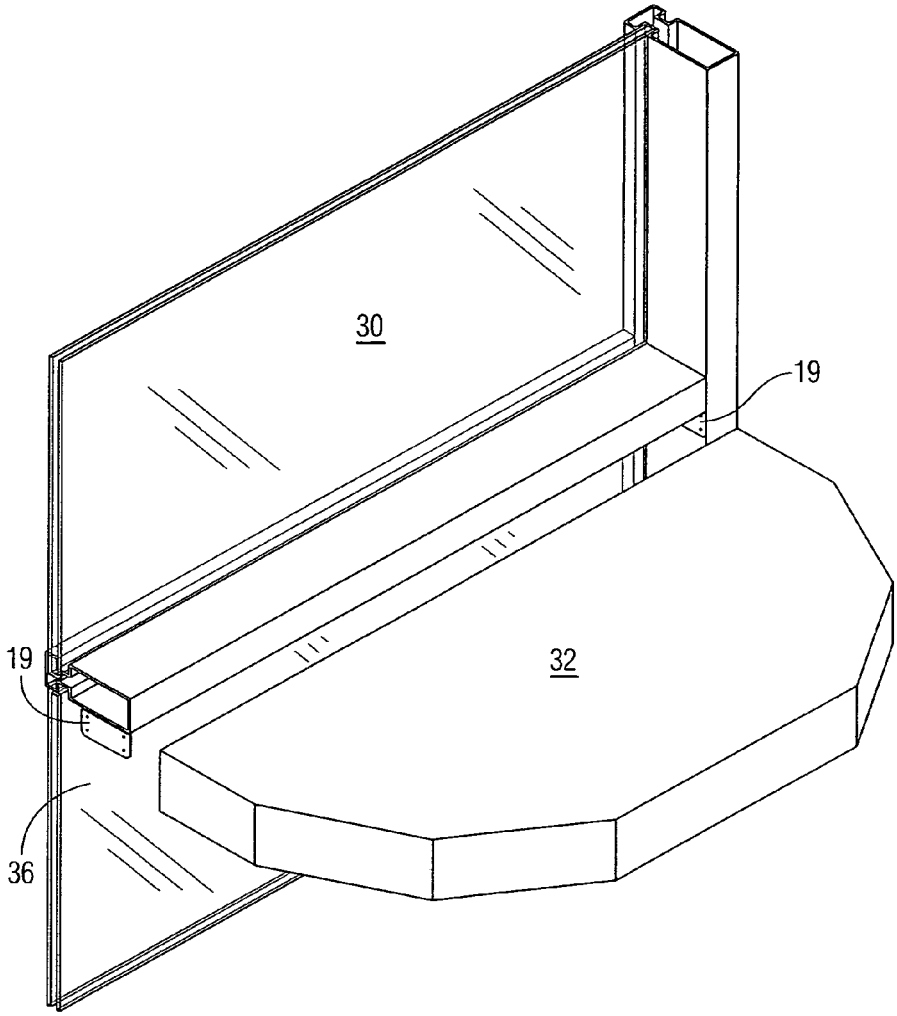
FIG. 3 is a perspective view of the embodiment shown in FIG. 1 with the curtain blanket member removed for clarity showing the positioning of the attachment brackets attached in this embodiment with respect to the curtain wall framing members.
Figure 4:
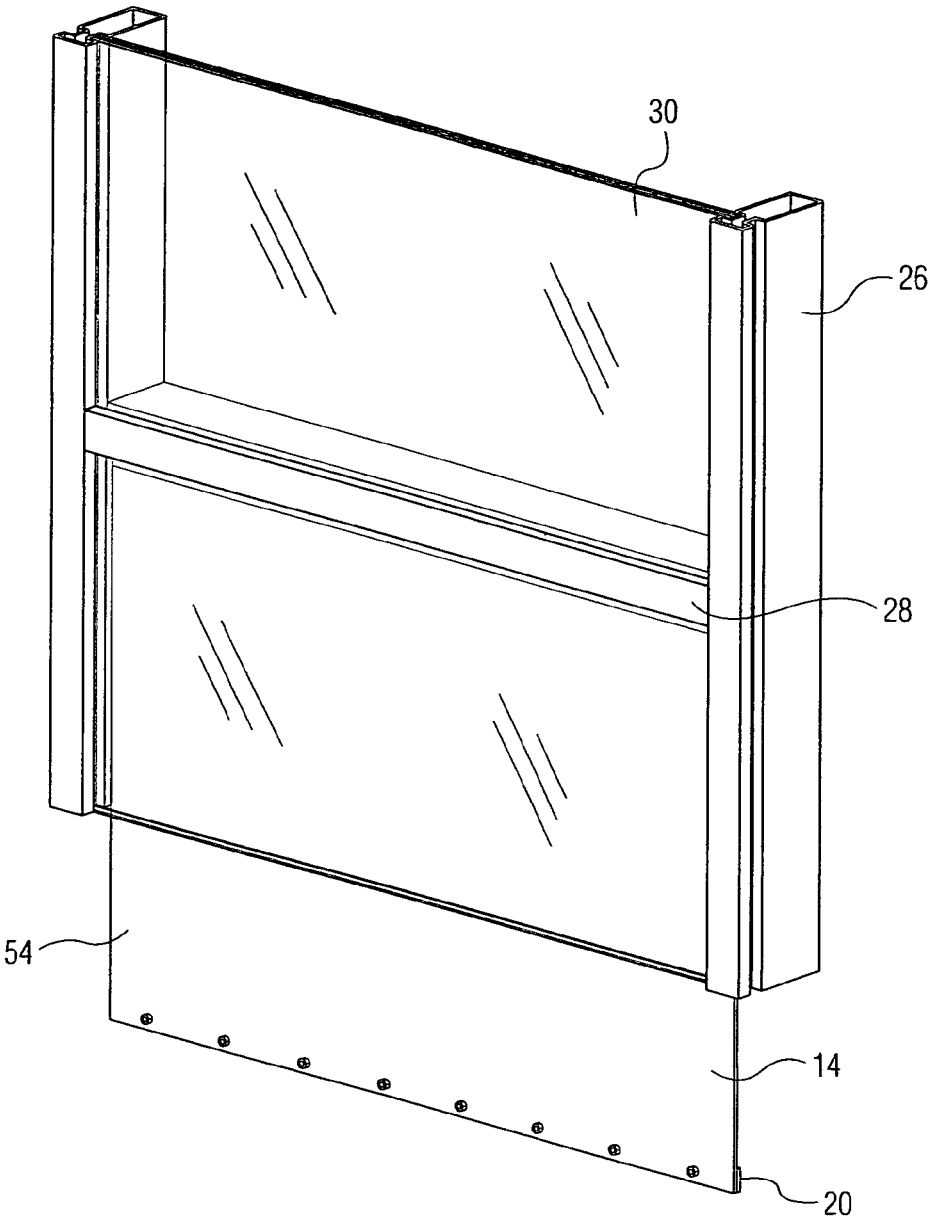
FIG. 4 is a perspective view of the construction of the present invention shown from the outside of the building illustrating the curtain blanket member deployed and extending over at least a portion of the curtain wall panel.
Figure 5:
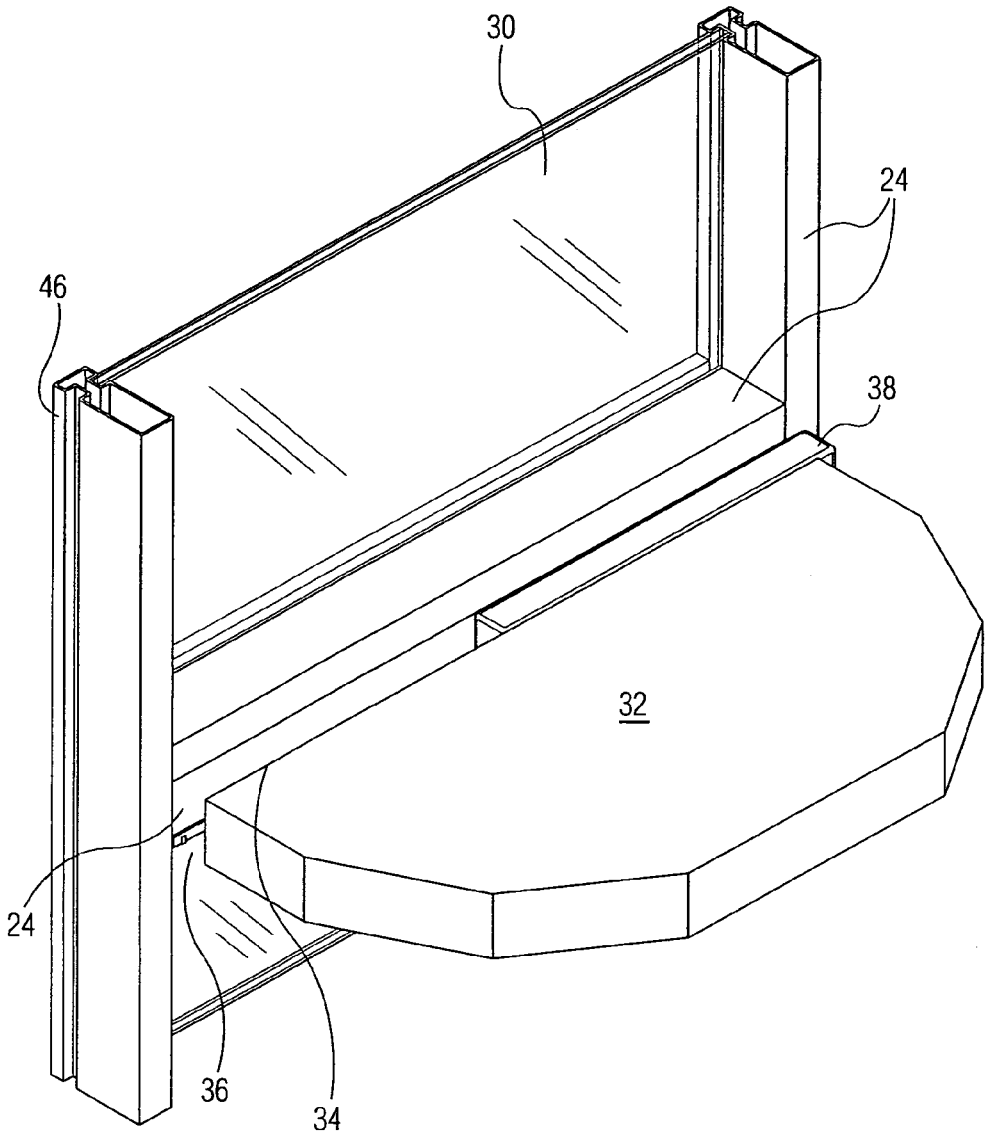
FIG. 5 is a perspective view of the illustration shown in FIG. 1 with the curtain blanket member removed for clarity and with a firestopping pillow positioned between the outer edge of the concrete floor and the safing angle member for firestop sealing therebetween.
Figure 6:
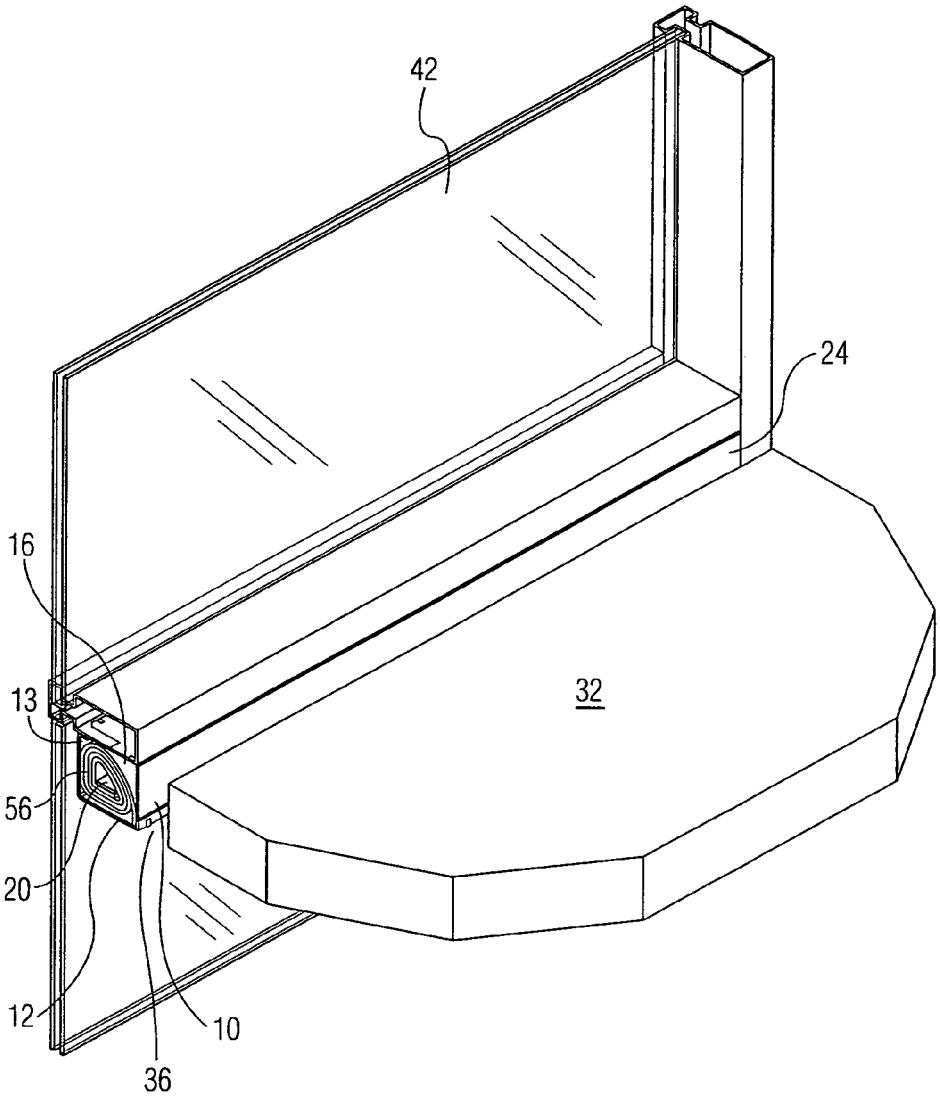
FIG. 6 is a perspective view of the construction of the present invention showing a rolled curtain blanket member retained within the retaining chamber defined between the safing angle member and the cover member.
Figure 7:
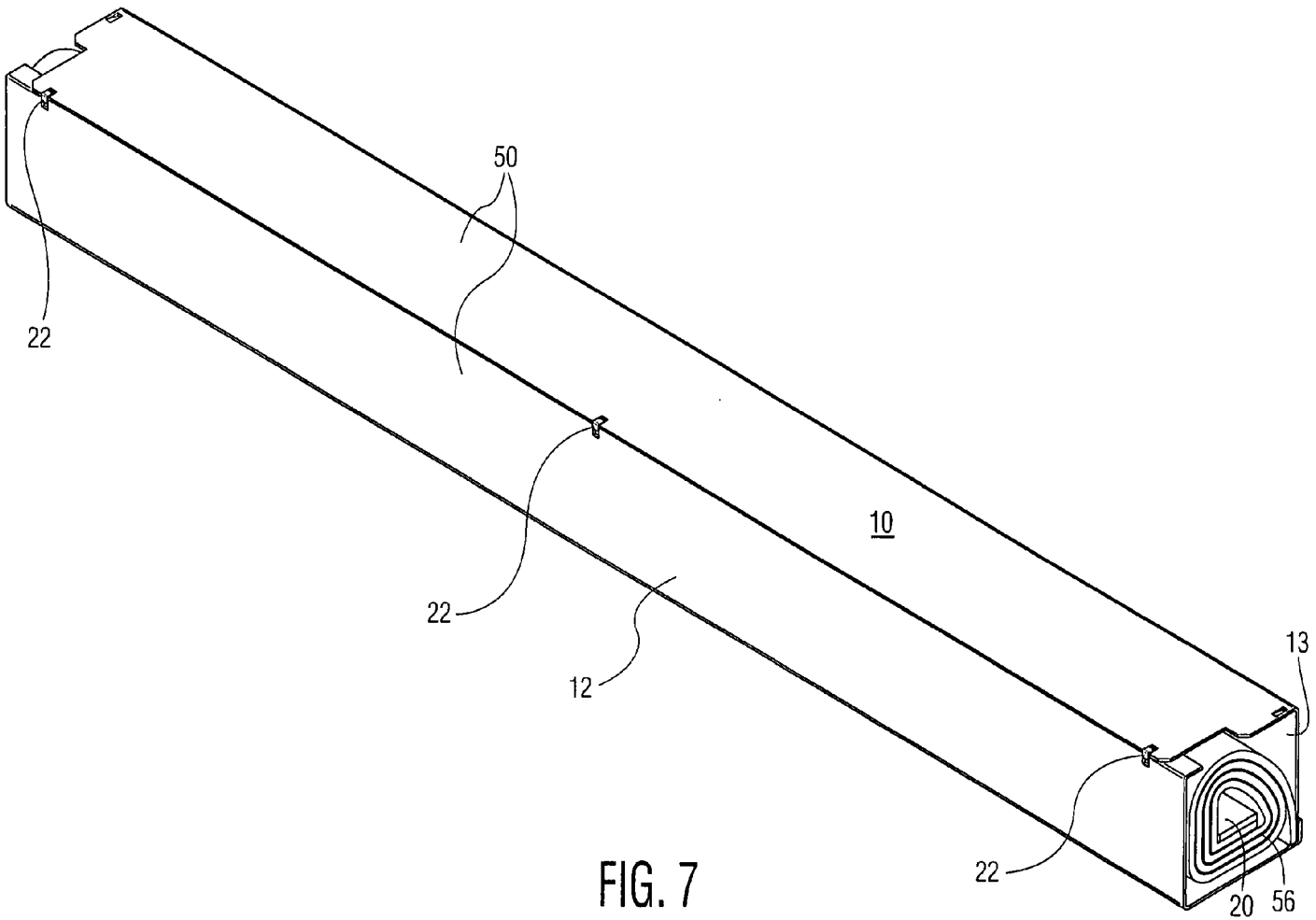
FIG. 7 is a perspective illustration showing the entire safing angle member with a cover member secured thereto and the fusible links maintaining securement therebetween and showing a curtain blanket member therewithin which is rolled.
Figure 8:
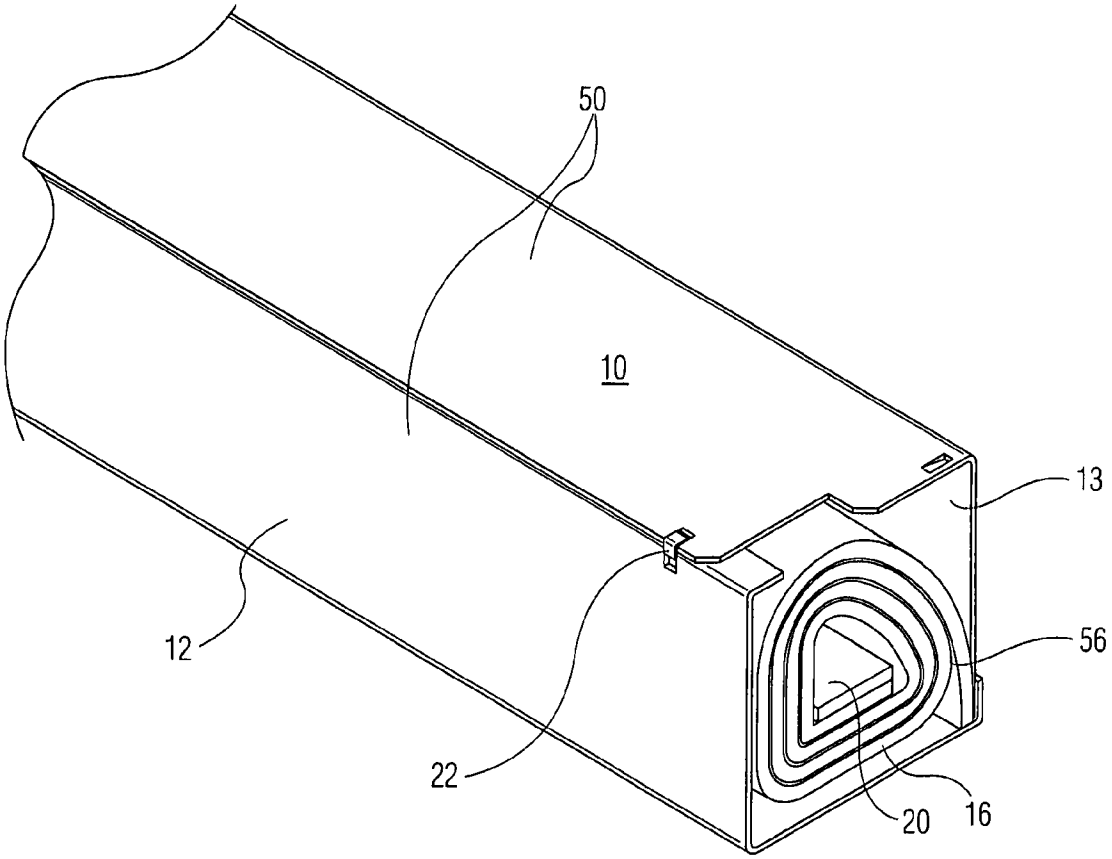
FIG. 8 is a perspective illustration of the embodiment shown in FIG. 7 illustrating an expanded view of the end thereof to more fully show the rolled configuration of the curtain with the activation weight positioned therewithin.

In this position the vertical length of the deployed curtain blanket 14 will cover a significant portion of the curtain wall panel 30 to which it is adjacent. In some applications it may be necessary to cover the entire curtain wall panel 30 such that the curtain blanket member 14 will extend completely downwardly over the entire expanse of the curtain wall panel 30 thereadjacent and, preferably, to the upper edge of the floor 32 located therebelow. However, it has been found that the prevention of the spreading of fire upwardly along the outside edge of the building can be achieved in some building constructions by the deployment of a curtain blanket member 14 which extends downwardly to a limited distance of perhaps two, three or four feet. Use of such s curtain blanket member 14 positioned downwardly across a significant part of the upper portion of the curtain wall panel 30 will form a sufficient barrier to the movement of flame even though it terminates at a position short of the lowermost edge curtain panel edge. Effective prevention of fire from passing through a fractured wall panel area can thus be achieve even though the curtain blanket only extends downward over the upper portion of a wall panel area. As long as the curtain blanket extends downwardly from the uppermost portion of the curtain wall panel adjacent to the edge of the floor thereabove, prevention of the spreading of fire outwardly through the fractured curtain wall panel can be achieved. Thus, it is within the contemplation of the present invention that the curtain blanket member 14 when fully deployed as shown in FIG. 1 can extend down a limited distance along the curtain wall panel 30 or, if deemed necessary can extend downwardly to an extent to cover the entire curtain wall panel 30 depending upon the requirements of the particular application. The apparatus of the present invention is preferably attached to the vertical framing members 26 or the horizontal framing members 28 by way of attachment brackets 19. These attachment brackets 19 are best shown in FIG. 3. The brackets 19 could be attached to either the vertical frame members 26 or the horizontal frame members 28 or can be attached to both for firm securement of the safing angle member 10 with respect to the curtain wall 24. The brackets could also be attached to the adjacent upper floor or the safing insulation therearound.

Figure 10:
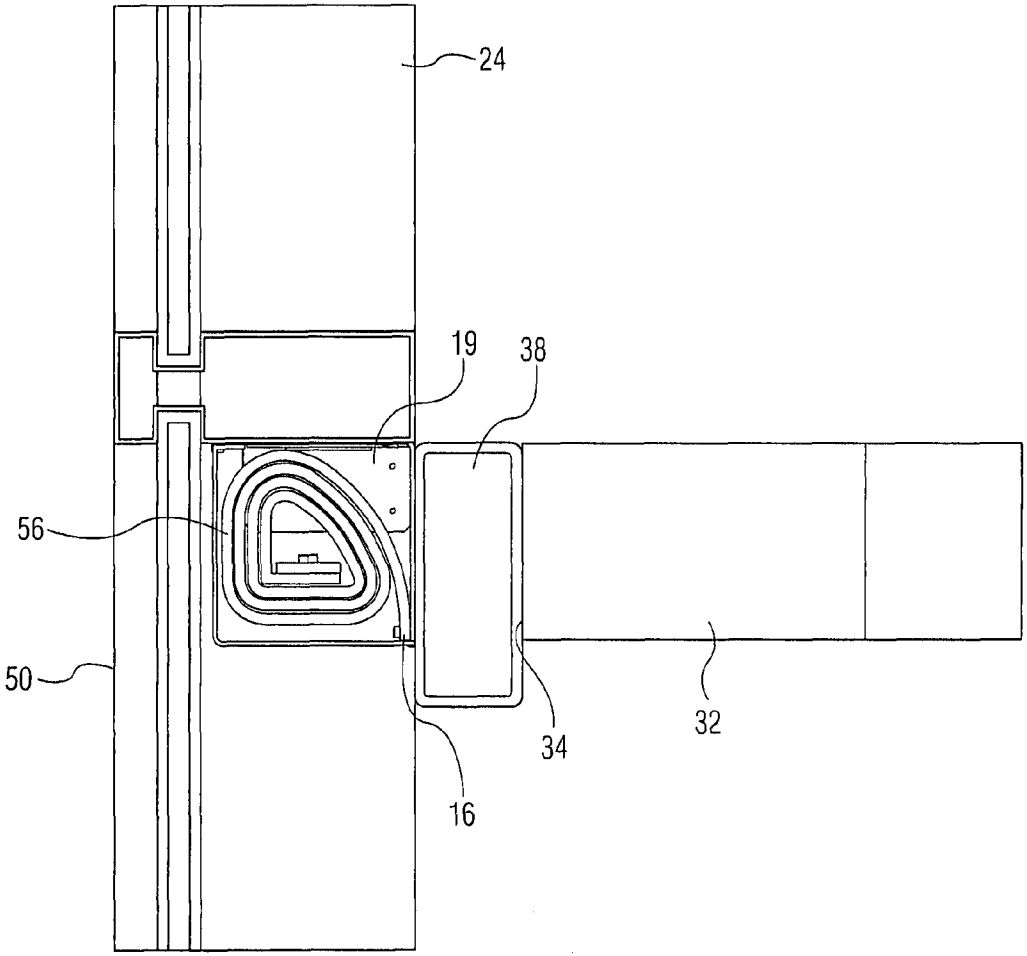
FIG. 10 is an illustration showing the embodiment of FIG. 9 secured in place to a curtain wall with the safing gap insulation member attached thereto and positioned within the safing gap defined between the curtain wall and the outer edge of the building floor with the curtain blanket member in the retained non-deployed state.
Figure 11:
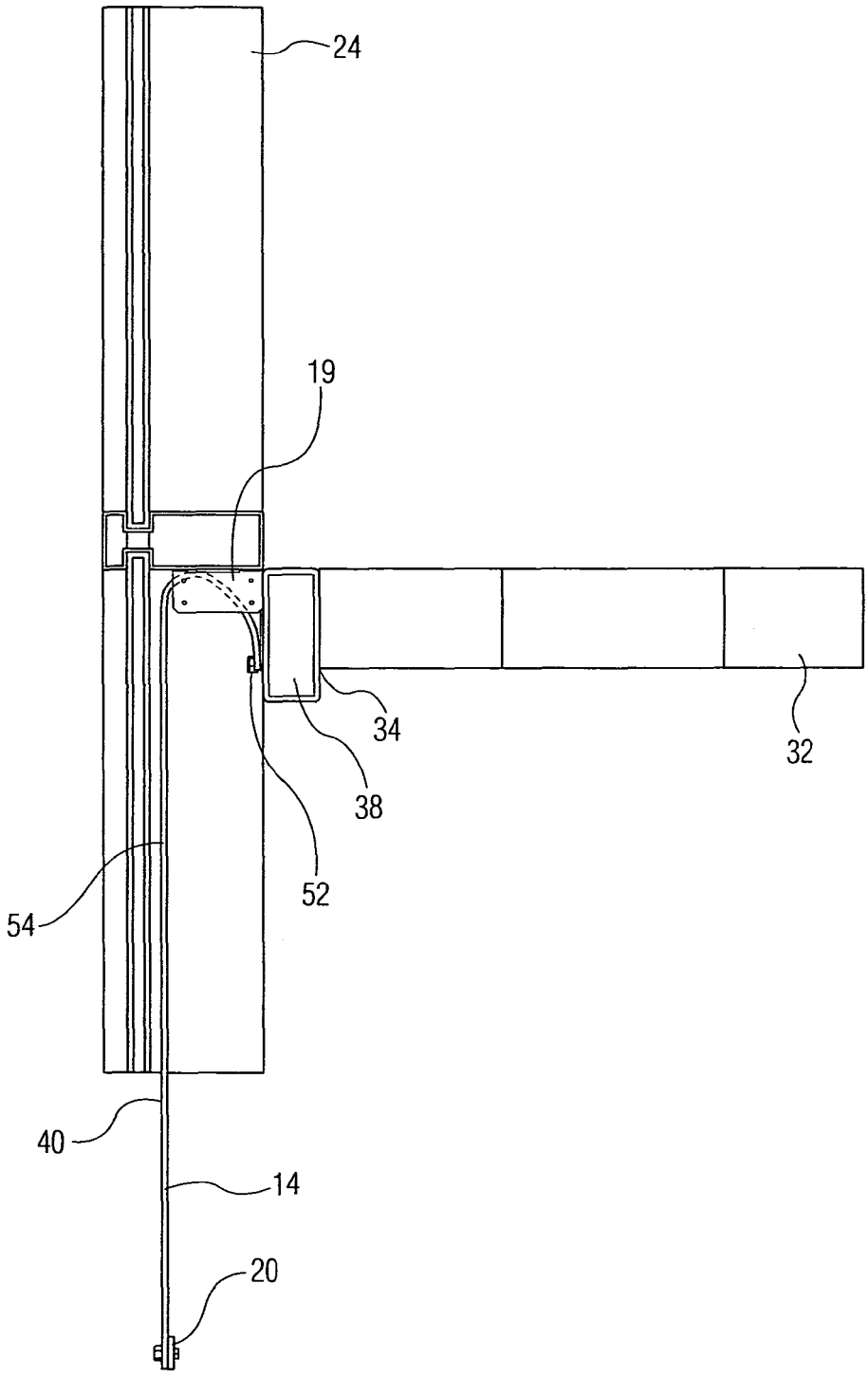
FIG. 11 is an illustration of the embodiment shown in FIG. 10 after the curtain blanket member has been fully deployed downwardly therefrom.
Figure 12:
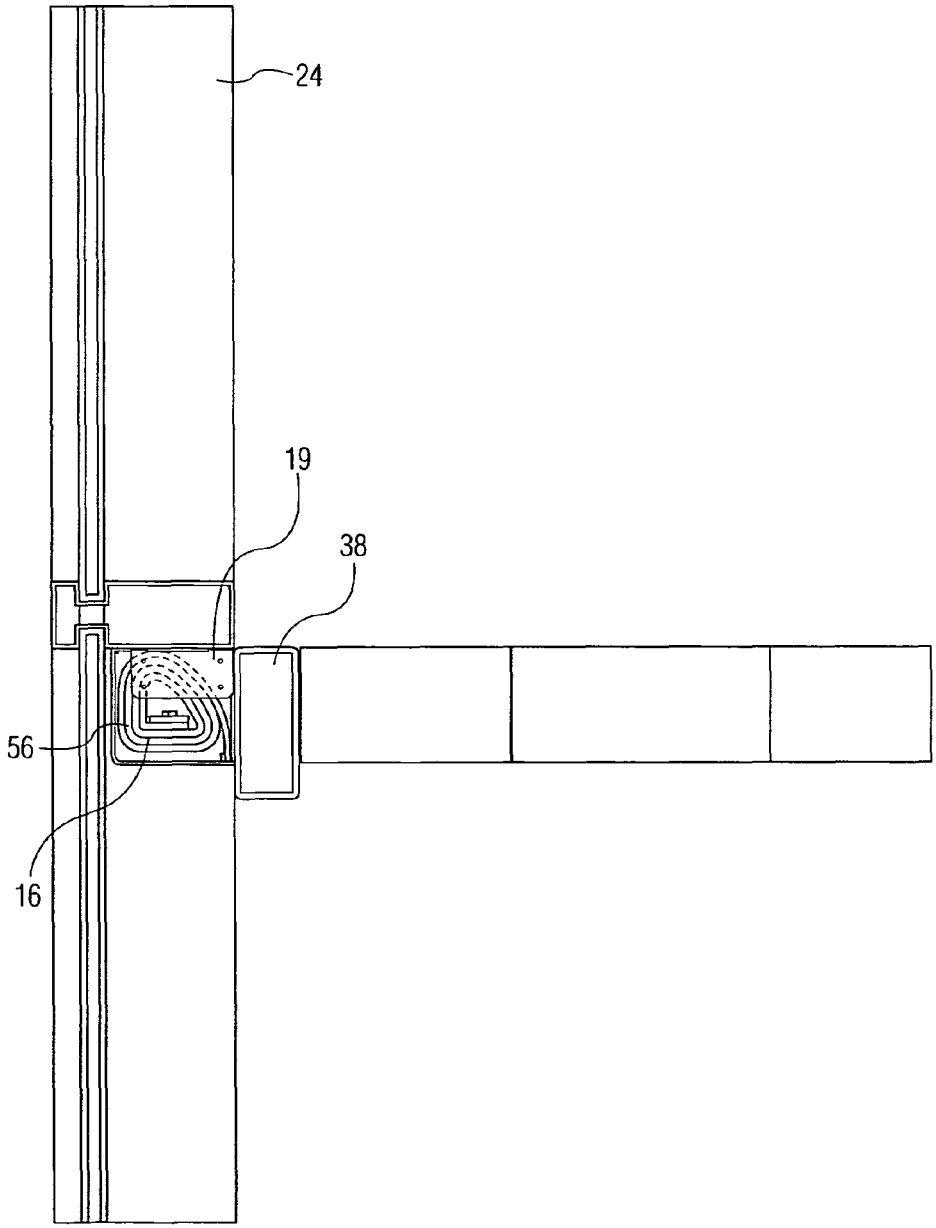
FIG. 12 is an illustration of the embodiment shown in FIG. 11 prior to deployment thereof.

To form an effective complete firestopping means for preventing the spread of fire vertically between floors, it is preferable that a safing gap insulation member 38 be positioned within the safing gap 36. For this purpose a fire retardant gasket or pillow can be attached, preferably to the downwardly extending leg of the safing angle member 10 prior to installation such that when it is placed in position attached to the curtain wall 24 the safing gap insulation pillow 38 will already be positioned in abutment with the outer floor edge 34 of adjacent floor 32 thereby effectively sealing the safing gap 36 as best shown in FIG. 10 with a minimum of labor time.

As such, the present invention provides a drop down blanket 14 preferably of flexible firestopping material such that it will prevent the spread of fire floor to floor outside of the edge of a conventional floor or slab through fractured curtain wall panels 30 which are often made of glass. The curtain blanket member 14 will preferably be formed of a thin fire retardant ceramic fiber material. Such materials need only be flexible and fire retardant and many cloth-like or other woven materials can be used while maintaining the effective construction shown to be advantageous in this construction whether they are folded or rolled.

The curtain blanket member 14 is attached at multiple locations to the safing angle member 10 which is preferably of steel. The retained and undeployed curtain blanket member 14 is secured in place within the retaining chamber 13 by the cover member 12 which is attached to the safing angle member 10 such as to define the retaining chamber 13 therewithin only by the fusible links 22. These fusible links 22 can be of lead or plastic or other similar material having a very low melting point such that when fire conditions exist the cover member 12 will fall away and allow deployment of the curtain blanket member 14.

It should be appreciated that the safing angle member 10 can be secured to the curtain wall 24 with respect to the vertical frame members 26 or with to the horizontal frame members 28 or both.

The safing gap insulation member 38 preferably is a flexibly resilient compressible fire retardant material such as a mineral fiber cushion or pillow. Such a mineral fiber cushion is normally encapsulated with polyethylene facing and, preferably, is affixed in any conventional means with respect to the downward protruding leg of the safing angle member 10. In this manner the construction of the safing angle member 10 and cover member 12 with the curtain blanket 14 retained therewithin and the safing gap insulation member 38 attached to the outer surface of the safing angle member 10 can be attached as a single unitary construction with respect to the curtain wall 24 prior to installation thereof which greatly facilitates such installation and minimizes labor costs. It should be appreciated that an aesthetic cover may extend over the operating construction of this invention including extending over the safing angle member 10 and the cover member 12 to conceal the curtain during normal building operations.

It should be appreciated that when the construction of the present invention including the safing angle member 10 and the cover member 12 and the retained blanket 14 with the safing gap insulation member 38 secured to the safing angle member can be installed in a single step prior to installation of the curtain wall 24 and for this reason the flexibility of the safing gap insulation member 38 becomes very important. This construction preferably will comprise a flexible mineral fiber cushion 38 which will then act as a gasket as it compresses against the outer floor edge 34 of the building interior floor slab 32 which seals off the vertical path between adjacent floors between the curtain wall 24 and the building interior floor 32, which is preferably a concrete slab. In such installations it is common, however, to include a separate membrane which may be factory applied or can be applied at the job site which starts from the upper surface of the slab adjacent to the safing gap and extends across the upper surface of the safing gap 36 to the curtain wall 24. This separate membrane preferably provides a secondary seal for water or water vapor.

The secured portion 52 of curtain blanket member 14 which is preferably formed of a ceramic fiber material is preferably secured with respect to the safing angle member 10 at multiple locations to maintain connection therebetween before and after deployment. Similarly the activation weight 20 will be secured with respect to the free portion 54 of the blanket member 14 at multiple locations to maintain connection therebetween before after deployment.

It should be appreciated that the construction of the safing angle member 10 and the cover member 12 which define the retaining chamber 13 with the undeployed blanket member 14 contained therewithin can be usable with various different configurations of safing gap insulation members 38. For example, a field directed system of mineral wool with firestop caulking or spray could be installed into the gap between the outer edge 34 of the floor slab 32 and the downwardly projecting leg of the safing angle member 10. Furthermore the safing angle member 10 could be secured in certain applications instead with respect to the outer edge 34 of the floor slab 32 and extend into the curtain wall cavity to provide protection in a similar manner. With this construction it may or may not be necessary to provide additional safing gap insulation 38 for effectively sealing of the safing gap 36 completely for assuring full firestop sealing between the curtain wall 24 and the outer floor edge 34.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

We claim:

1. A curtain wall construction having a means for firestopping thereover comprising:

A. a curtain wall assembly comprising:

(1) a plurality of vertical framing members spatially disposed from one another and extending generally vertically;

(2) a plurality of horizontal framing members spatially disposed from one another and extending generally horizontally between said vertical framing members;

(3) a plurality of curtain wall panels extending between said vertical framing members and between said horizontal framing members;

B. a firestopping means cooperatively positioned immediately adjacent said curtain wall assembly for facilitating firestopping thereover responsive to exposure to fire conditions, said firestopping means being attached directly to said curtain wall assembly and extendable to a position deployed between said vertical framing members and along said horizontal framing members at locations extending over and immediately adjacent said curtain wall panels positioned extending therebetween, said firestopping means comprising:

(1) a retaining housing positioned adjacent said curtain wall assembly, said retaining housing including:

(a) a safing angle member positioned adjacent to said curtain wall assembly and attached directly thereto;

(b) a cover member detachably secured to said safing angle member and defining therebetween a retaining chamber means;

(c) a releasable attachment means detachably securing said cover member with respect to said safing angle member, said releasable attachment means being responsive to exposure to fire conditions to disengage said cover member from said safing angle member; and (2) a curtain blanket including a secured portion thereof secured with respect to said safing angle member and also including a free portion thereof, said curtain blanket being flexible and fire-resistant and positionable collapsed in a stored position within said retaining chamber means of said retaining housing, said releasable attachment means being responsive to fire conditions to disengage said cover member from attachment with respect to said safing angle member to allow said free portion of said curtain blanket to deploy by exiting said retaining chamber means and moving downwardly to a deployed position extending at least partially across said curtain wall panel located immediately thereadjacent for firestopping thereover.

2. A curtain wall construction having a means for firestopping thereover as defined in claim 1 wherein said releasable attachment means comprises a fusible link which is adapted to melt responsive to exposure to fire conditions.

3. A curtain wall construction having a means for firestopping thereover as defined in claim 1 wherein said curtain blanket is rolled when in the storage position within said retaining chamber means.

4. A curtain wall construction having a means for firestopping thereover as defined in claim 1 wherein said curtain blanket is folded when in the storage position within said retaining chamber means.

5. A curtain wall construction having a means for firestopping thereover as defined in claim 1 wherein said curtain blanket includes an activation weight secured to said free portion thereof to facilitate downward movement of said free portion from the stored position to the deployed position extending across said curtain wall panel located thereadjacent.

6. A curtain wall construction having a means for firestopping thereover as defined in claim 1 wherein said cover member is made of a non-metallic or aluminum material.

7. A curtain wall construction having a means for firestopping thereover as defined in claim 1 wherein said curtain blanket is made of a fire retardant ceramic fiber.

8. A curtain wall construction having a means for firestopping thereover as defined in claim 1 wherein said safing angle member is secured directly to said curtain wall assembly to facilitate positioning thereof adjacent and above said curtain wall panel.

9. A curtain wall construction having a means for firestopping thereover as defined in claim 1 for use with building interior floors having an outer floor edge positioned spatially disposed from said curtain wall assembly and defining a safing gap therebetween, said firestopping means further including a safing gap insulation member attached to said safing angle member of said retaining housing and positioned extending inwardly therefrom into the safing gap and into abutment with the outer edge of the building interior floor to achieve firestop sealing of the safing gap thereadjacent.

10. A curtain wall construction having a means for firestopping thereover as defined in claim 9 wherein said safing gap insulation member comprises a mineral fiber cushion encapsulated within a thermoplastic facing material.

11. A curtain wall construction having a means for firestopping thereover as defined in claim 1 wherein when in the deployed position said free portion of said curtain blanket extends downwardly across the entire expanse of said curtain wall panel.

12. A curtain wall construction having a means for firestopping thereover as defined in claim 1 wherein when in the deployed position said free portion of said curtain blanket extends downwardly across only an upper portion of the entire expanse of said curtain wall panel.

13. In combination with a curtain wall construction including a curtain wall assembly including a plurality of vertical framing members spatially disposed from one another and extending generally vertically, and a plurality of horizontal framing members spatially disposed from one another and extending generally horizontally between the vertical framing members, and a plurality of curtain wall panels extending between the vertical framing members and between the horizontal framing members, the improvement comprising a firestopping means cooperatively positioned immediately adjacent the curtain wall assembly for facilitating firestopping thereover responsive to exposure to fire conditions, said firestopping means being attached directly to the curtain wall assembly and extendible to a position deployed between the vertical framing members and along the horizontal framing members at locations extending over and immediately adjacent the curtain wall panels positioned extending therebetween, said firestopping means comprising:

(1) a retaining housing positioned adjacent the curtain wall assembly, said retaining housing including:
   (a) a safing angle member positioned adjacent to the curtain wall assembly and attached directly thereto;
   (b) a cover member detachably secured to said safing angle member and defining therebetween a retaining chamber means;
   (c) a releasable attachment means detachably securing said cover member with respect to said safing angle member, said releasable attachment means being responsive to exposure to fire conditions to disengage said cover member from said safing angle member; and (2) a curtain blanket including a secured portion thereof secured with respect to said safing angle member and also including a free portion thereof, said curtain blanket being flexible and fireresistant and positionable collapsed in a stored position within said retaining chamber means of said retaining housing, said releasable attachment means being responsive to exposure to fire conditions to disengage said cover member from attachment with respect to said safing angle member to allow said free portion of said curtain blanket to deploy by exiting said retaining chamber means and moving downwardly to a deployed position extending at least partially across the curtain wall panel located immediately thereadjacent for firestopping thereover.

14. The firestopping means for use with a curtain wall construction as defined in claim 13 wherein said releasable attachment means comprises a fusible link which is adapted to melt responsive to exposure to fire conditions.

15. The firestopping means for use with a curtain wall construction as defined in claim 13 wherein said curtain blanket is rolled when in the storage position within said retaining chamber means.

16. The firestopping means for use with a curtain wall construction as defined in claim 13 wherein said curtain blanket is folded when in the storage position within said retaining chamber means.

17. The firestopping means for use with a curtain wall construction as defined in claim 13 wherein said curtain blanket includes an activation weight secured to said free portion thereof to facilitate downward movement of said free portion from the stored position to the deployed position extending across the curtain wall panel located thereadjacent.

18. The firestopping means for use with a curtain wall construction as defined in claim 13 wherein said cover member is made of a non-metallic or aluminum material.

19. The firestopping means for use with a curtain wall construction as defined in claim 13 wherein said curtain blanket is made of a fire retardant ceramic fiber.

20. The firestopping means for use with a curtain wall construction as defined in claim 13 wherein said safing angle member is secured directly to the curtain wall assembly to facilitate positioning thereof adjacent and above the curtain wall panel.

21. The firestopping means for use with a curtain wall construction as defined in claim 13 for use with building interior floors having an outer floor edge positioned spatially disposed from the curtain wall assembly and defining a safing gap therebetween, said firestopping means further including a safing gap insulation member attached to said safing angle member of said retaining housing and positioned extending inwardly therefrom into the safing gap and into abutment with the outer edge of the building interior floor to achieve firestop sealing of the safing gap thereadjacent.

22. The firestopping means for use with a curtain wall construction as defined in claim 21 wherein said safing gap insulation member comprises a mineral fiber cushion encapsulated within a thermoplastic facing material.

23. The firestopping means for use with a curtain wall construction as defined in claim 13 wherein when in the deployed position of said free portion of said curtain blanket extends downwardly across the entire expanse of the curtain wall panel.

24. The firestopping means for use with a curtain wall construction as defined in claim 13 wherein when in the deployed position said free portion of said curtain blanket extends downwardly across only an upper portion of the entire expanse of the curtain wall panel.

* * * * *